US008662344B2

(12) United States Patent
Gispert

(10) Patent No.: US 8,662,344 B2
(45) Date of Patent: Mar. 4, 2014

(54) INSULATING SYSTEM FOR HOT AND COLD BEVERAGES

(75) Inventor: Valentin Ortiz Gispert, Madrid (ES)

(73) Assignee: Stor, S.L., Madrid (ES)

( * ) Notice: Subject to any disclaimer, the term of this patent is extended or adjusted under 35 U.S.C. 154(b) by 71 days.

(21) Appl. No.: 13/042,559

(22) Filed: Mar. 8, 2011

(65) Prior Publication Data

US 2012/0228310 A1 Sep. 13, 2012

(51) Int. Cl.
*A47G 19/22* (2006.01)
*B65D 81/38* (2006.01)

(52) U.S. Cl.
CPC ..... *A47G 19/2288* (2013.01); *B65D 81/3872* (2013.01)
USPC ..... 220/592.17; 220/62.18; 220/62.12

(58) Field of Classification Search
USPC ..... 220/592.17, 62.18, FOR. 140, FOR. 138, 220/592.16, 592.01, 62.12, 62.11
See application file for complete search history.

(56) References Cited

U.S. PATENT DOCUMENTS

| | | | | | |
|---|---|---|---|---|---|
| 2,979,463 | A | * | 4/1961 | Ferguson | 252/70 |
| 3,161,031 | A | * | 12/1964 | Flannery | 62/457.4 |
| 3,302,428 | A | * | 2/1967 | Paquin et al. | 62/457.4 |
| 3,389,160 | A | * | 6/1968 | Reid | 556/423 |
| 3,958,101 | A | * | 5/1976 | Barabas | 392/378 |
| 4,273,667 | A | | 6/1981 | Kent et al. | |
| 4,357,809 | A | * | 11/1982 | Held et al. | 62/457.4 |
| 4,394,930 | A | * | 7/1983 | Korpman | 220/62.18 |
| 4,570,454 | A | * | 2/1986 | Campbell | 62/457.3 |
| 4,782,670 | A | * | 11/1988 | Long et al. | 62/457.4 |
| 5,001,907 | A | * | 3/1991 | LaCroix et al. | 62/457.4 |
| 5,573,141 | A | | 11/1996 | Chen | |
| 5,674,428 | A | * | 10/1997 | Lott et al. | 252/70 |
| 5,876,620 | A | | 3/1999 | Tsai | |
| 2007/0144703 | A1 | * | 6/2007 | Kolowich | 165/10 |

* cited by examiner

*Primary Examiner* — Robert J Hicks
(74) *Attorney, Agent, or Firm* — B. Aaron Schulman, Esq.; Stites & Harbison, PLLC.

(57) ABSTRACT

An insulated container having an outer vessel and an inner vessel, containing an insulative fluid formed from a mixture of water and a water absorptive poly(potassium acrylate) polymer in the approximate ratio of 50:1 (cc:g), that can be heated or cooled and that reduces heat transfer from hot or cold beverages, particularly well-suited for use in connection with both hot and cold beverages, to maintain the liquid either hot or cold.

4 Claims, 3 Drawing Sheets

INSULATING SYSTEM FOR HOT AND COLD BEVERAGES

FIELD OF THE INVENTION

The present invention relates to insulated containers containing insulating fluids that reduce heat transfer from hot or cold beverages.

BACKGROUND OF THE INVENTION

Insulated mugs, glasses, cups and other containers that are adapted to insulate a hot beverage in order reduce heat loss and maintain the temperature of the beverage are well known. Typically, these containers are insulated with a material that is well-suited to reducing heat transfer from the hot beverage. The insulating material is often disposed in a space provided between an outer wall and an inner wall of the container. Some insulated containers can even be microwaved such that the insulating material, and therefore the container itself, can actually be heated. In this way, the heat transfer from the hot beverage to the environment can be reduced, such that the beverage remains warm over a longer period of time.

Vacuum flasks (such as a Thermos®), which have a vacuum chamber disposed between inner and outer walls of the container, are also known which reduce the rate of heat transfer between the ambient environment and the beverage.

Insulated containers are specifically contemplated for holding cold beverages. Such containers can include a heat transfer fluid that is disposed between inner and outer walls of the container. In some instances, the heat transfer fluid can be cooled to a temperature below the freezing point of water when placed in a freezer or other similar apparatus. In this way, when the container is used to hold a cold beverage the heat transfer fluid can absorb heat from the ambient environment and reduce heat transfer from the ambient environment to the cold beverage, keeping the beverage cooler for a longer period.

Insulating fluids of the prior art in general, including U.S. Pat. No. 5,876,620 to Tsai describe a mixture of water and a water absorptive polysodium acrilate in a ratio of 13:1 (cc:g), together with using calcium chloride as a freeze resistance substance and sodium benzoate as a preservative/antiseptic agent. However, as clearly described in Tsai, the fluid is used for cooling mugs only, not suitable for heating and maintaining hot liquids.

There is a distinct lack of containers that are insulated with a material well-suited for reducing heat transfer from a hot beverage and reducing heat absorption by a cold beverage. Accordingly, there is need for a container having an insulative fluid that is well-suited for keeping both cold beverages cool and hot beverages warm.

SUMMARY OF THE INVENTION

The present application provides a container system and an insulative fluid that is well-suited for use with both hot and cold beverages.

In at least one embodiment, the present application provides a container for reducing heat transfer from and to a beverage, the container having an outer vessel having an upper rim defining an open end, the outer vessel having an inner surface and an outer surface, an inner cavity having an upper rim defining an open end, the inner cavity having an inner surface and an outer surface, the inner cavity suspended within the outer vessel and adapted to receive beverages therein, the upper rim of the inner cavity being integrally joined to the upper rim of the outer vessel, the outer surface of the inner cavity and the inner surface of the outer vessel defining a sealed chamber therebetween, and an insulative fluid substantially filling the sealed chamber, the insulative fluid formed from a mixture of water and a water absorptive poly(potassium acrylate) polymer in the approximate ratio of 50:1 (cc:g).

DETAILED DESCRIPTION OF THE INVENTION

The present application provides an insulative fluid that is particularly well-suited for use in connection with both hot and cold beverages, to maintain the liquid either hot or cold. More specifically, the present application provides a container filled with an insulative fluid that can be heated or cooled and that reduces heat transfer from a hot or cold beverage. For the purposes of the present disclosure, reducing heat transfer will be understood to mean reducing heat transfer from a hot beverage to the external environment and reducing heat transfer from the external environment to a cold beverage.

Figure 1:
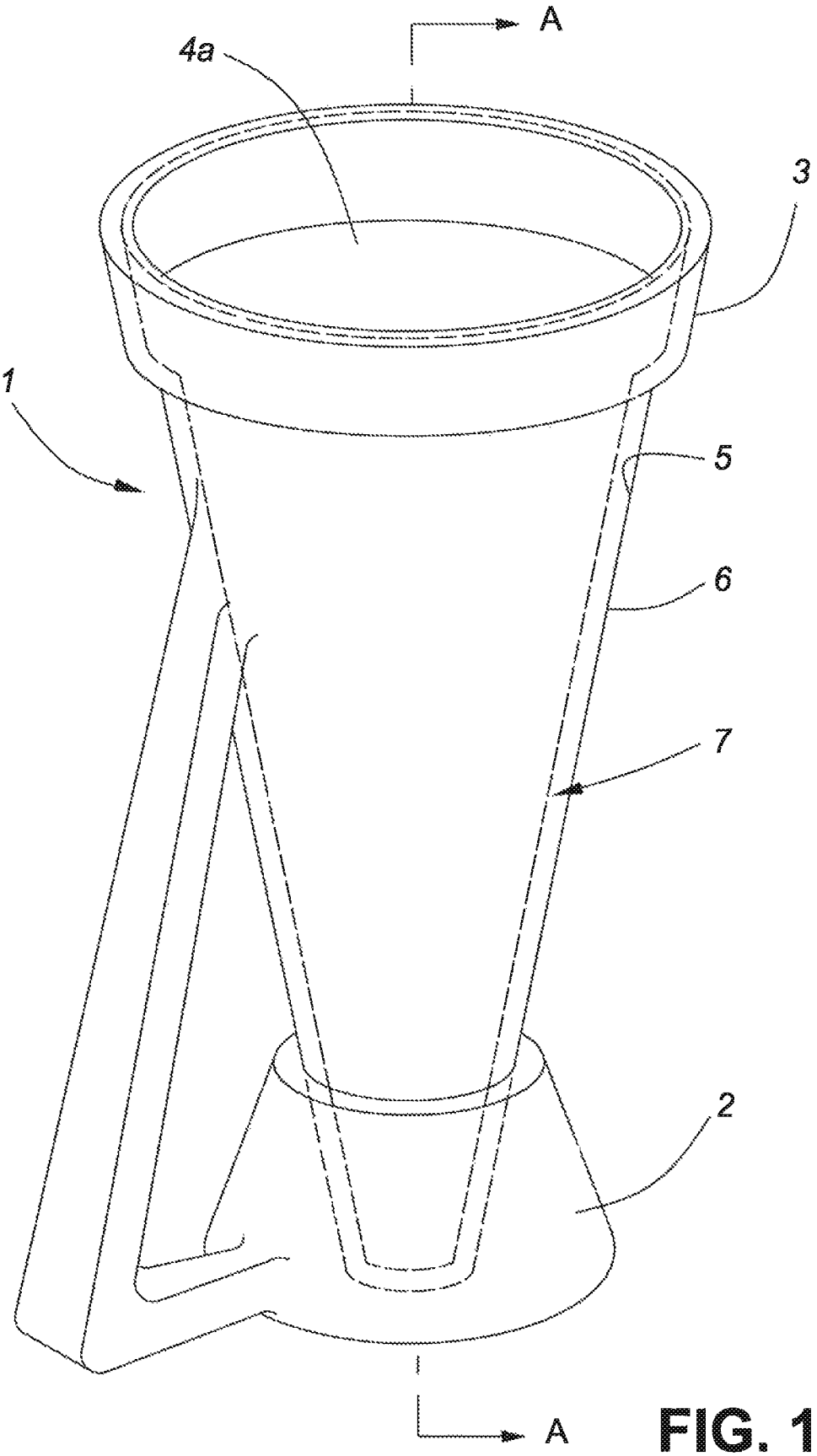
FIG. 1 shows a perspective view of the outer vessel and juxtaposed inner vessel.

FIG. 1 shows a preferred embodiment, having an outer vessel (1) which includes a base (2) and an upper rim (3), the upper rim defining an open end (4*a*). The outer vessel has an inner surface (5) and also an outer surface (6).

Figure 2:
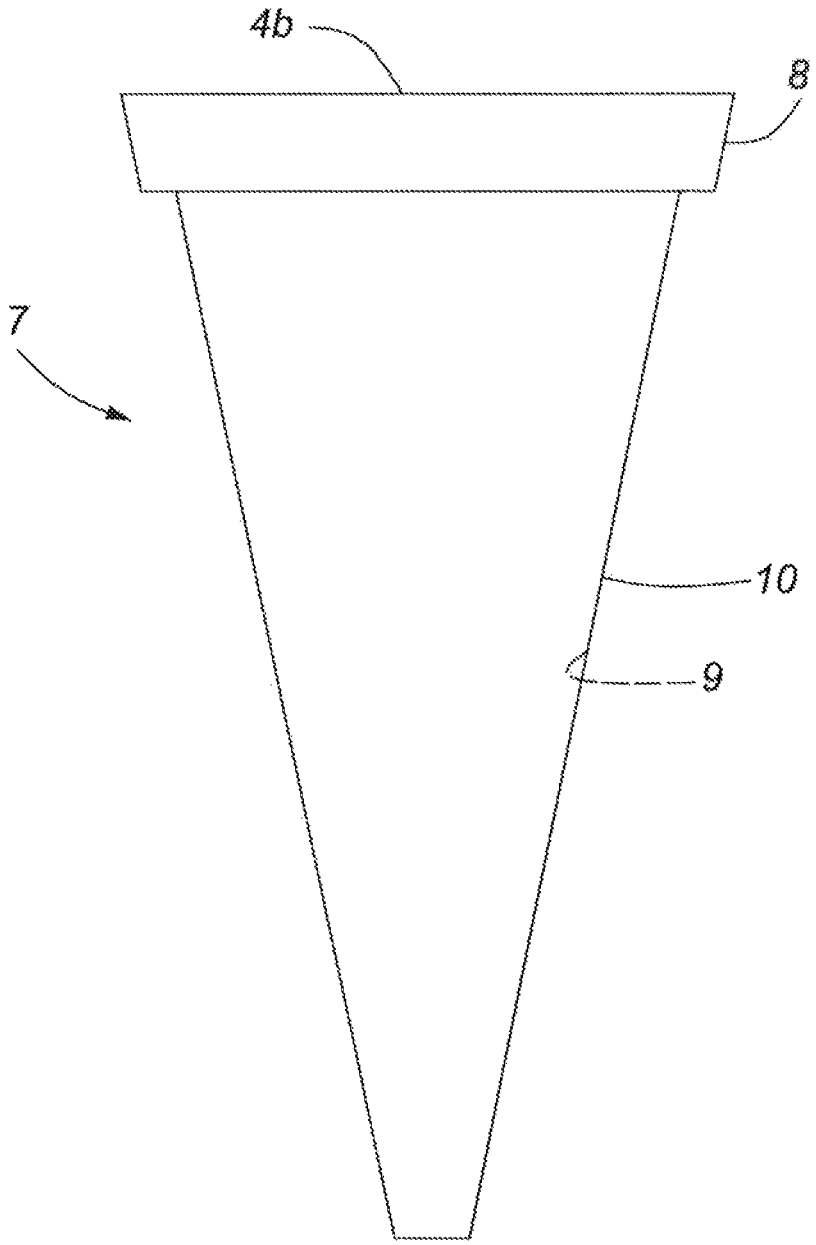
FIG. 2 shows the inner vessel.

In FIG. 2, the inner vessel can be seen. The inner vessel (7) has an upper rim (8) defining an open end (4*b*), which will be juxtaposed with open end (4*a*) of the outer vessel. The inner vessel also has an inner surface (9) and an outer surface (10).

Figure 3:
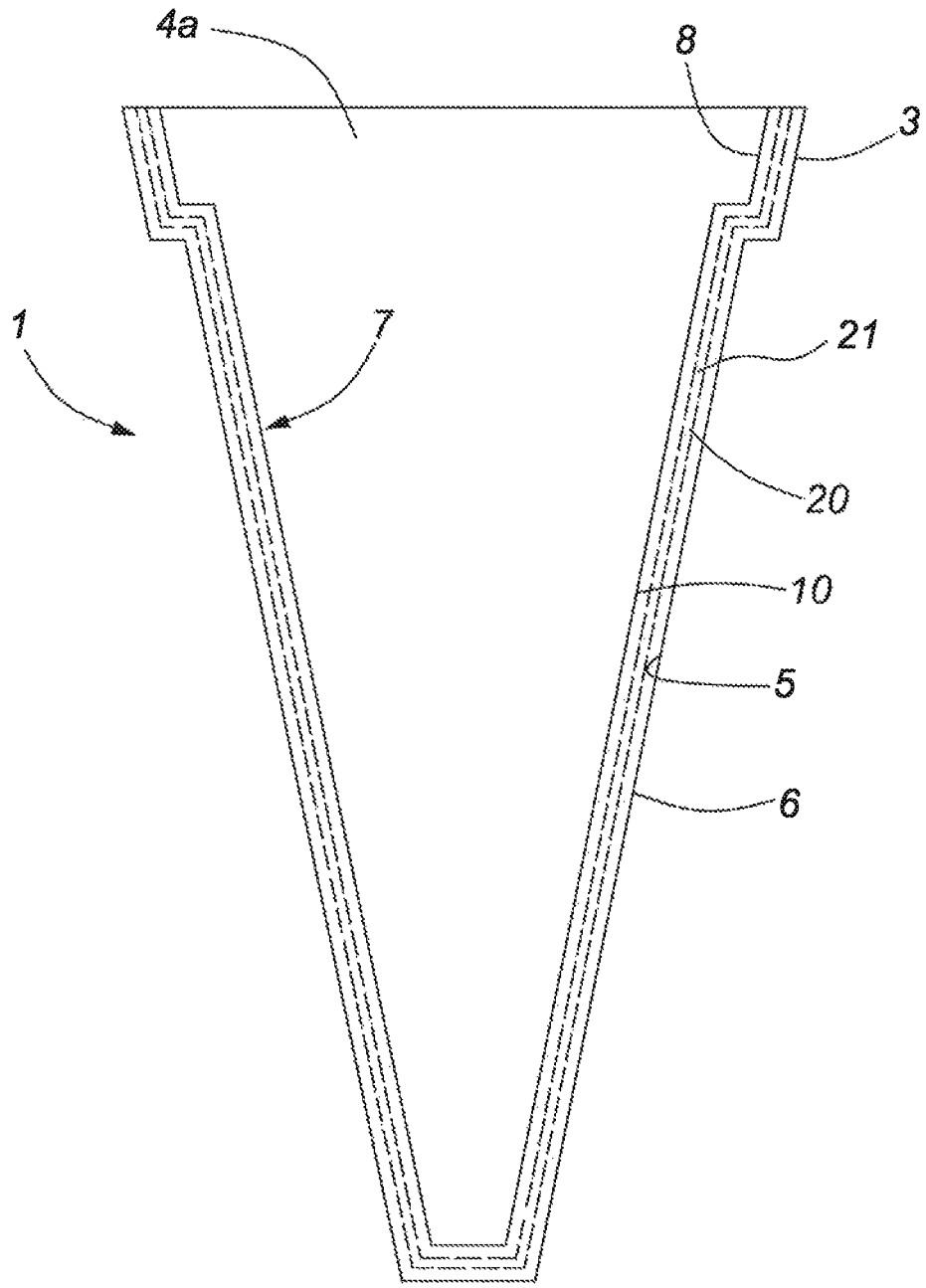
FIG. 3 shows longitudinal CUT A from FIG. 1.

In FIG. 3, the CUT A from FIG. 1 is shown, where the inner vessel is shown juxtaposed and coupled or suspended within the outer vessel. In this coupling of the inner and outer vessels the upper rim (8) of the inner vessel (7) is integrally joined to the upper rim (3) of the outer vessel (1). After the coupling the outer surface (10) of the inner vessel and the inner surface (5) of the outer vessel define a sealed chamber (20) therebetween. The sealed chamber is then substantially filled with the insulative fluid (21), which is particularly well-suited for use in connection with both hot and cold beverages.

The coupled outer (1) and inner (7) vessels with the sealed chamber (20) filled with the insulative fluid (21), which is particularly well-suited for use in connection with both hot and cold beverages is then adapted and will allow the container to receive beverages therein. The beverage will be maintained either hot or cold.

The insulative fluid of the present application can be manufactured in any colour as will be appreciated by the skilled person in the art. The insulated containers of the present application can be microwaved such that the insulating material, and therefore the container itself, can be heated and maintain a hot beverage hot.

In at least one embodiment, the present application provides an insulative fluid is provided that contains at least poly(potassium acrylate). Poly(potassium acrylate) is a polymer with the chemical formula $(C_3H_3KO_2)_n$ and particularly adept at absorbing water.

In at least one embodiment, an insulative fluid is provided wherein the poly(potassium acrylate) is mixed with water in the ratio of 50 cubic centimeters of water in solution with 1 gram of poly(potassium acrylate). In this way, an insulative fluid can be produced in a very cost effective manner as very little polymer is utilized in the final mixture in comparison to prior art solutions.

In at least one embodiment, the present application provides an insulative fluid that further contains sodium chloride. Sodium chloride is well-known and has the chemical formula NaCl. As discussed above, the present insulative fluid is water based. Accordingly, and as will be understood by the skilled person, sodium chloride is included to raise the freezing point of the insulative fluid, such that the insulative fluid can be lowered to a temperature below the freezing point of water without solidifying.

Further, when dissolved in water sodium chloride also provides antimicrobial properties. Accordingly, sodium chloride is particularly well suited for use as an antimicrobial agent in food-grade containers as it is a naturally occurring non-toxic compound.

In at least one embodiment, the present application provides an insulative fluid is provided that further contains ascorbic acid.

Ascorbic acid is a sugar acid with antioxidant properties and has the chemical formula $C_6H_8O_6$. Ascorbic Acid is a well known preservative and is contemplated for use in connection with the present application to provide an insulative fluid that is resistant to microbial growth. Ascorbic acid is particularly well suited for use as an antimicrobial agent in food-grade containers as it is a naturally occurring non-toxic compound.

In at least one embodiment, an insulative fluid is provided wherein the poly(potassium acrylate) is mixed with water in the ratio of 50 cubic centimeters of water in solution with 1 gram of poly(potassium acrylate). Using 1 gram of ingredient over 50 CC of water has a distinctive advantage of using less ingredient to yield higher volume, saving production costs.

As will be recognized by the skilled person, there are a wide variety of containers known in the prior art that will be suitable for use in connection with the present application. In at least one embodiment, a suitable container will have an outer vessel having an upper rim defining an open end and an inner cavity having an upper rim defining an open end. The inner cavity is suspended within the outer vessel, and accordingly the inner cavity is sized slightly smaller than the outer vessel. The inner vessel is contemplated to hold a hot or cold beverage.

In this embodiment, the upper rim of the outer vessel is joined to the upper rim of the inner cavity. A sealed chamber is disposed between an outer surface of the inner cavity and an inner surface of the outer vessel. The sealed chamber is substantially filled with one of the embodiments of the insulative fluids described herein.

A suitable container can be constructed of any material that is compatible (i.e. non-reactive) with the disclosed insulative fluids, as will be understood by the skilled person, including but not limited to various plastics and stainless steel. A suitable container may or may not include a handle formed of a suitable material.

The above-described embodiments of the present application are meant to be illustrative of preferred embodiments of the present application and are not intended to limit the scope of the present application. Various modifications, which would be readily apparent to one skilled in the art, are intended to be within the scope of the present application. The only limitations to the scope of the present application are set out in the following appended claims.

I claim:

1. A container for reducing heat transfer from a beverage, the container comprising:

(a) an outer vessel having a base and an upper rim defining an open end, said outer vessel having an inner surface and an outer surface;

(b) an inner vessel having an upper rim defining an open end, said inner vessel having an inner surface and an outer surface, said inner vessel suspended within said outer vessel and adapted to receive beverages therein, said upper rim of said inner cavity being integrally joined to said upper rim of said outer vessel, said outer surface of said inner vessel and said inner surface of said outer vessel defining a sealed chamber therebetween, and, (c) an insulative fluid substantially filling said sealed chamber, said insulative fluid formed from a mixture of water and a water absorptive poly(potassium acrylate) polymer in the approximate ratio of 50:1 (cc:g);

wherein said container maintains hot beverages at a hot temperature and cold beverages at a cold temperature.

2. The container as recited in claim 1, wherein said insulative fluid is formed from a mixture of 100 cc of water and 2 g of water absorptive poly(potassium acrylate) polymer.

3. The container as recited in claim 1 further comprising sodium chloride (NaCl) added to said mixture to impart freezing resistant properties thereto.

4. The container as recited in claim 1 further comprising ascorbic acid added to said mixture as a preservative.

* * * * *